US009434045B2

(12) United States Patent
Yeh et al.

(10) Patent No.: US 9,434,045 B2
(45) Date of Patent: Sep. 6, 2016

(54) PLANARIZATION DEVICE AND PLANARIZATION METHOD USING THE SAME

(71) Applicant: Macronix International Co., Ltd., Hsinchu (TW)

(72) Inventors: Yu-Hua Yeh, Hsinchu (TW); Liang-Yu Hu, Hsinchu County (TW); Tang-Tsai Chang, Hsinchu County (TW); Ming-Tsan Lai, Zhubei (TW)

(73) Assignee: MACRONIX INTERNATIONAL CO., LTD., Hsinchu (TW)

( * ) Notice: Subject to any disclaimer, the term of this patent is extended or adjusted under 35 U.S.C. 154(b) by 171 days.

(21) Appl. No.: 14/269,370

(22) Filed: May 5, 2014

(65) Prior Publication Data

US 2015/0318179 A1 Nov. 5, 2015

(51) Int. Cl.

| | |
|---|---|
| ***B24B 37/04*** | (2012.01) |
| ***B24B 37/34*** | (2012.01) |
| ***B24B 55/00*** | (2006.01) |
| ***B24B 37/10*** | (2012.01) |

(52) U.S. Cl.

CPC ..... *B24B 37/04* (2013.01); *B24B 37/042* (2013.01); *B24B 37/105* (2013.01); *B24B 37/34* (2013.01); *B24B 55/00* (2013.01)

(58) Field of Classification Search

CPC ..... B24B 37/04; B24B 37/34; B24B 55/00; H01L 21/304

USPC ..... 451/41, 287–290, 446, 60, 455, 457

See application file for complete search history.

(56) References Cited

U.S. PATENT DOCUMENTS

| | | | | |
|---|---|---|---|---|
| 5,738,574 A * | 4/1998 | Tolles | B08B 1/007 | 257/E21.23 |
| 5,957,751 A * | 9/1999 | Govzman | B24B 37/0053 | 451/289 |
| 6,183,354 B1 * | 2/2001 | Zuniga | B24B 37/32 | 451/285 |

FOREIGN PATENT DOCUMENTS

GB 189209 11/1922

OTHER PUBLICATIONS

TIPO Office Action dated Feb. 22, 2016 in corresponding Taiwan application (No. 103115658).

* cited by examiner

*Primary Examiner* — Robert Rose

(74) *Attorney, Agent, or Firm* — McClure, Qualey & Rodack, LLP

(57) ABSTRACT

A planarization device and a planarization method using the same are provided. The planarization device comprises a platen, a grinding pad, an operation arm, a chuck and a shielding pad. The grinding pad is disposed on the platen. The operation arm has a lower surface. The chuck rotatably is disposed on the operation arm. The shielding pad is detachably disposed on the lower surface of the operation arm.

16 Claims, 3 Drawing Sheets

PLANARIZATION DEVICE AND PLANARIZATION METHOD USING THE SAME

BACKGROUND

1. Technical Field

The disclosure relates in general to a planarization device and a planarization method using the same and more particularly to a planarization device having a shielding pad and a planarization method using the same.

2. Description of the Related Art

In a planarizing process, slurry is easy to be spurted to an operation arm of a planarization device. The slurry contains a large number of solid particles, causing the solid particles spurted to the operation arm to be crystallized as a crystallized particle with large size. When the crystallized particle with large size drops to the grinding pad during the planarizing process, a grinded substrate is easy to be scraped.

SUMMARY

The disclosure is directed to a planarization device and a planarization method using the same, in one embodiment, the problem of the grinded substrate being easy to be scraped may be improved or resolved.

One aspect of the disclosure relates to a planarization device. In one embodiment, the planarization device comprises a platen, a grinding pad, an operation arm, a chuck and a first shielding pad. The grinding pad is disposed on the platen. The operation arm has a lower surface. The chuck rotatably is disposed on the operation arm. The first shielding pad is detachably disposed on the lower surface of the operation arm.

Another aspect of the disclosure relates to a planarization method for semiconductor structure. The planarization method comprises the following steps. A planarization device according to claim 1 is provided; a semiconductor structure is provided, wherein the semiconductor structure comprises a substrate and a layer structure formed on the substrate; the chuck picks up the semiconductor structure; and the chuck drives the layer structure of the semiconductor structure to rotate and touch the grinding pad for planarizing the layer structure.

The following description is made with reference to the accompanying drawings.

DETAILED DESCRIPTION

Figure 1A:
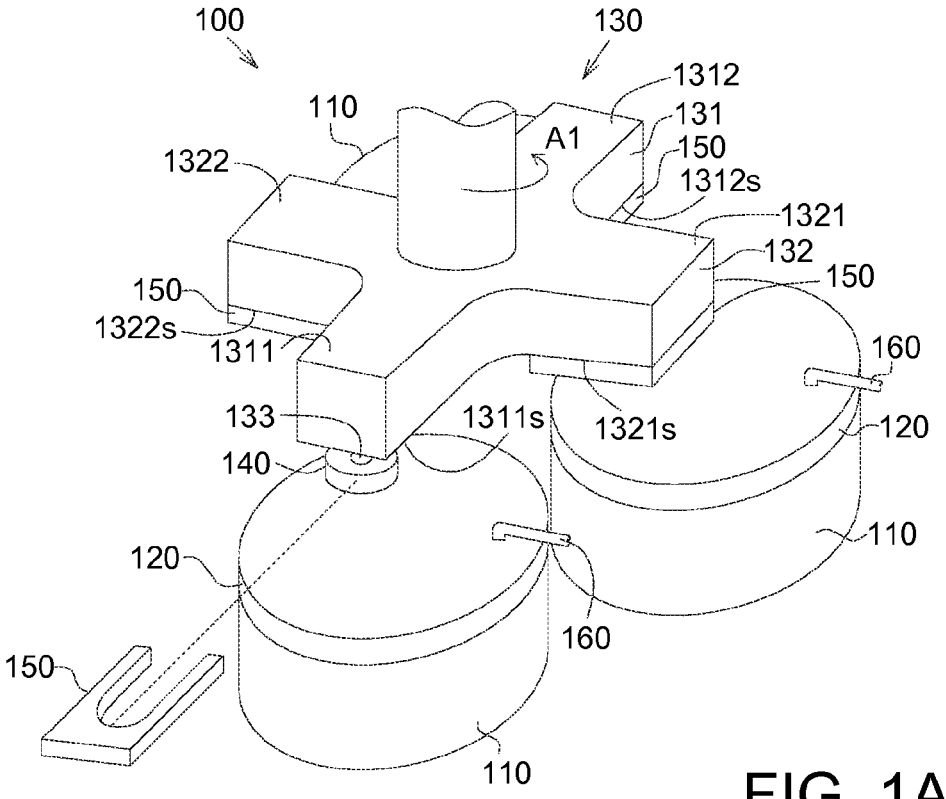
FIG. 1A illustrates an appearance view of a planarization device according to an embodiment of the invention.
Figure 1B:
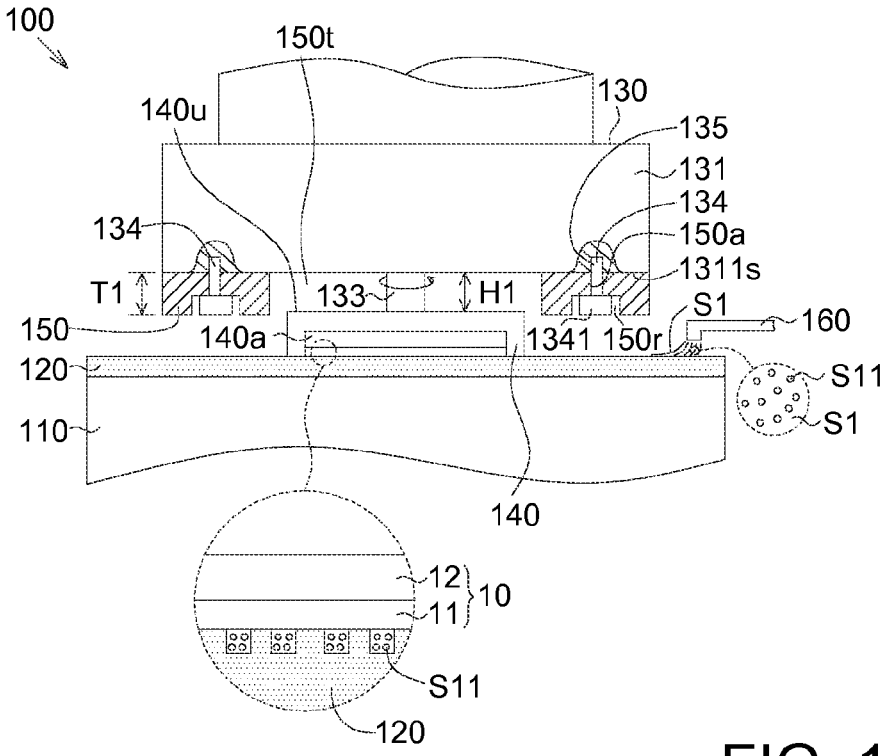
FIG. 1B illustrates a cross-section view of a local portion of the planarization device of FIG. 1A.

FIG. 1A illustrates an appearance view of a planarization device according to an embodiment of the invention, and FIG. 1B illustrates a cross-section view of a local portion of the planarization device of FIG. 1A. The planarization device 100 comprises a plurality of platens 110, a plurality of grinding pads 120, an operation arm 130, a plurality of chucks 140 and a plurality of first shielding pads 150.

As illustrated in FIG. 1A, each grinding pad 120 is disposed on the corresponding platen 110 for grinding a layer structure 11 (as illustrated in FIG. 1B) of a semiconductor substrate 10 (as illustrated in FIG. 1B). When the grinding process of the semiconductor substrate 10 is finished in one of the platens 110, the operation arm 130 may rotate an angle, such as 45 degrees, to drive the semiconductor substrate 10 to next platen 110 for performing the corresponding grinding process. The planarization for the semiconductor structure 10 is finished after the semiconductor structure 10 is grinded by the grinding pads 120 in the platens 110 in order.

As illustrated in FIG. 1B, the operation arm 130 comprises a plurality of rotating shafts 133, wherein each rotating shaft 133 is connected to the corresponding chuck 140. The rotating shaft 133 may revolve on its own axis to drive the chuck 140 to rotate. The chuck 140 has a receiving recess 140*a*. The semiconductor structure 10 is fixedly disposed within the receiving recess 140*a* through a vacuum force. The semiconductor structure 10 further comprises a substrate 12, such as a silicon wafer. The layer structure 11 is formed on the substrate 12. The planarization device 100 further comprises a plurality of spray nozzles 160, wherein each spray nozzle 160 may provide the corresponding grinding pad 120 with slurry S1 to grind the layer structure 11.

The slurry S1 is liquid with high viscosity and contains a large number of solid grinding particles S11. During planarizing process, the chuck 140 picks up the semiconductor structure 10 and press the layer structure 11 of the semiconductor structure 10 on the grinding pad 120 and simultaneously drives the semiconductor structure 10 to rotate, such that the solid grinding particle S11 on the grinding pad 120 may remove material of the layer structure 11 for planarizing the layer structure 11.

As illustrated in FIG. 1A, the operation arm 130 comprises a first arm 131 and a second arm 132, wherein the first arm 131 and the second arm 132 are configured as a cross structure. The first arm 131 comprises a first end 1311 having a first lower surface 1311*s* and a second end 1312 having a second lower surface 1312*s*. The second arm 132 comprises a third end 1321 having a third lower surface 1321*s* and a fourth end 1322 having a fourth lower surface 1322*s*.

The first shielding pads 150 are disposed on the first lower surface 1311*s* of the first arm 131, the second lower surface 1312*s* of the first arm 131, the third lower surface 1321*s* of the second arm 132 and the fourth lower surface 1322*s* of the second arm 132. Accordingly, the lower surfaces are prevented from being easily polluted by the slurry S1 (as illustrated in FIG. 1B). During the planarizing process. In detail, the pollution to the operation arm 130 may be reduced due to the protection provided by the shielding of the first shielding pads 150, and accordingly the maintenance cost and/or the discarding rate of the semiconductor structure 10 may be reduced.

In addition, the shielding pads 150 are detachably disposed on the operation arm 130. As a result, when a crystallized solid grinding particle S11 become an oversize crystallized particle, the shielding pad 150 with the oversize crystallized particle may be replaced with a new shielding pad 150. Accordingly, the oversize crystallized particle may be prevented from dropping to the grinding pad 120 to scrape the layer structure 11 of the semiconductor structure 10.

The shielding pads 150 may be formed by an anti-corrosive material such as plastic and high molecular polymer. In detail, the shielding pads 150 may be formed by polypropylene (PP) or poly(tetrafluoroethene).

As illustrated in FIG. 1B, a thickness T1 of each shielding pad 150 is larger than or substantially equal to a gap between the lower surface of the operation arm 130 and an upper surface of the corresponding chuck 140. For example, the thickness T1 of each shielding pad 150 is larger than or substantially equal to a gap H1 between the first lower surface 1311*s* of the first arm 131 of the operation arm 130 and the upper surface 140*u* of the corresponding chuck 140; under the design, the first shielding pad 150 may not extend within the gap H1. Since the thickness T1 of the first shielding pad 150 is sufficient to provide the requirement for strength; accordingly, the first shielding pad 150 still has adequate strength even though the volume of a notch 150*t* of the first shielding pad 150 is more (in comparison with the first shielding pad 150 extends within the gap H1). In an embodiment, the gap H1 ranges between 30 millimeters and 40 millimeters.

As illustrated in FIG. 1B, the planarization device 100 further comprises a plurality of locking components 134. The locking components 134 may fix a relative position between the first shielding pad 150 and the operation arm 130. In detail, the locking components 134*s*, such as bolts, are screwed to the operation arm 130 and the first shielding pad 150 for fixing the first shielding pad 150 to the operation arm 130. The locking components 134 have a quick disconnecting property, and accordingly required replacing time may be reduced.

Each first shielding pad 150 has a plurality of recesses 150*r* and a plurality of through holes 150*a*, wherein each through hole 150*a* passes through the first shielding pad 150 from a bottom surface of the corresponding recess 150*r*. The locking components 134 pass through the through hole 150*a* and are screwed to several screwed holes 135 of the operation arm 130 for fixing the first shielding pad 150 to the operation arm 130. In addition, at least one portion of a head 1341 of the locking component 134 may be received within the recess 150*r*, and accordingly the head 1341 of the locking component 134 may be prevented from projecting from the recess 150*r* to be interfered with other component.

Figure 2:
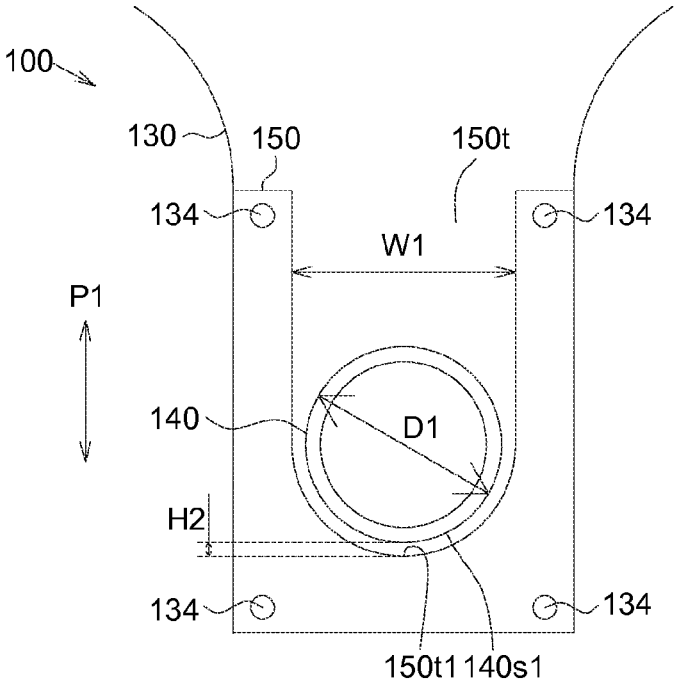
FIG. 2 illustrates a bottom view of the first shielding pad of FIG. 1B.

FIG. 2 illustrates a bottom view of the first shielding pad of FIG. 1B. Several locking components 134 are screwed to four corners of the first shielding pad 150 to fix the first shielding pad 150 to the operation arm 130. In another embodiment, several locking components 134 fix the first shielding pad 150 to the operation arm 130 along at least one edge of the first shielding pad 150. In addition, the number of the locking components 134 may be less or more than four.

As illustrated in FIG. 2, each first shielding pad 150 has a first notch 150*t*. In the present embodiment, a width of the first notch 150*t* is larger than an outer diameter D1 of the chuck 140, and accordingly the chuck 140 may be prevented from be interfered with the first shielding pad 150 during the chuck 140 rotating. During the planarizing process, the chuck 140 may periodically move back and forth in a direction P1 for increasing a material removing rate. The direction P1 is referred to a radial direction of the operation arm 130. To avoid the chuck 140 striking the first shielding pad 150 during the reciprocation, a first lateral surface 140*s*1 of the chuck 140 is separated from a bottom surface 150*t*1 of the first notch 150*t* by a first interval H2. The first interval H2 is larger than a distance of the chuck 140 moving toward the bottom surface 150*t*1, and according the chuck 140 may be prevented from striking the first shielding pad 150 during the chuck 140 moving toward the bottom surface 150*t*1 of the first notch 150*t*. In one embodiment, a reciprocation stroke of the chuck 140 ranges between 2 centimeter and 3 centimeter.

Figure 3:
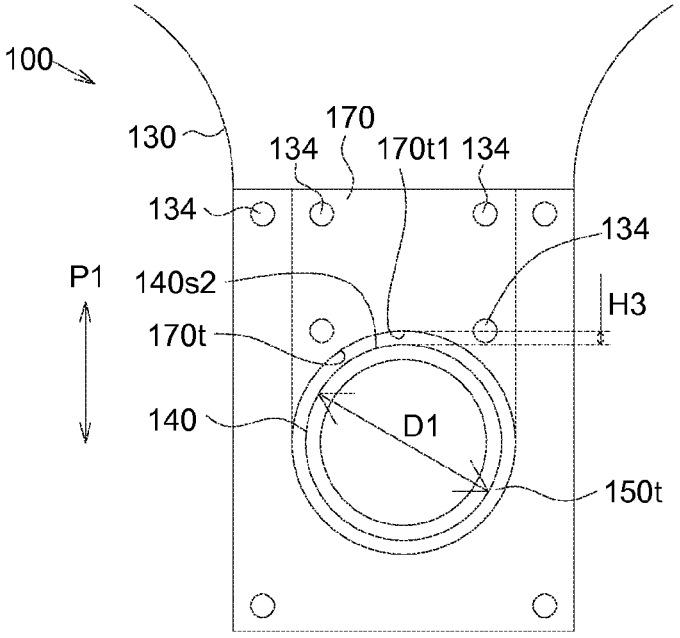
FIG. 3 illustrates a bottom view of the first shielding pad of a second shielding pad according to another embodiment of the invention.

FIG. 3 illustrates a bottom view of the first shielding pad of a second shielding pad according to another embodiment of the invention. In the present embodiment, the planarization device 100 further comprises a plurality of second shielding pads 170 (only one illustrated in FIG. 3). Like a function of the first shielding pad 150, the second shielding pad 170 may protect the operation arm 130 from being excessively polluted by the slurry S1. In addition, the second shielding pad 170 may be made of a material similar to that of the first shielding pad 150, and the similarities is not repeated.

Each second shielding pad 170 is disposed on the operation arm 130 and located within the first notch 150*t* of the corresponding first shielding pad 150. Each second shielding pad 170 has a second notch 170*t*. To avoid the chuck 140 strike the second shielding pad 170 during the reciprocation, a second lateral surface 140*s*2 of the chuck 140 is separated from a bottom surface 170*t*1 of the second notch 170*t* by a second interval H3. The second interval H3 is larger than a distance of the chuck 140 moving toward the bottom surface 170*t*1, and according the chuck 140 may be prevented from striking the second shielding pad 170 during the chuck 140 moving toward the bottom surface 170*t*1 of the second notch 170*t*.

In addition, the planarization device 100 further comprises several locking components 134. The locking components 134 are screwed to the second shielding pad 170 and the operation arm 130 for fixing the second shielding pad 170 to the operation arm 130. The locking components 134 are screwed to four corners of the second shielding pad 170 to fix the second shielding pad 170 to the operation arm 130. In another embodiment, the second shielding pad 170 may be fixed to the operation arm 130 through less than four locking components 134 or more than four or more than the locking components 134. Alternatively, several locking components 134 may fix the second shielding pad 170 to the operation arm 130 along at least one edge of the second shielding pad 170.

Figure 4A:
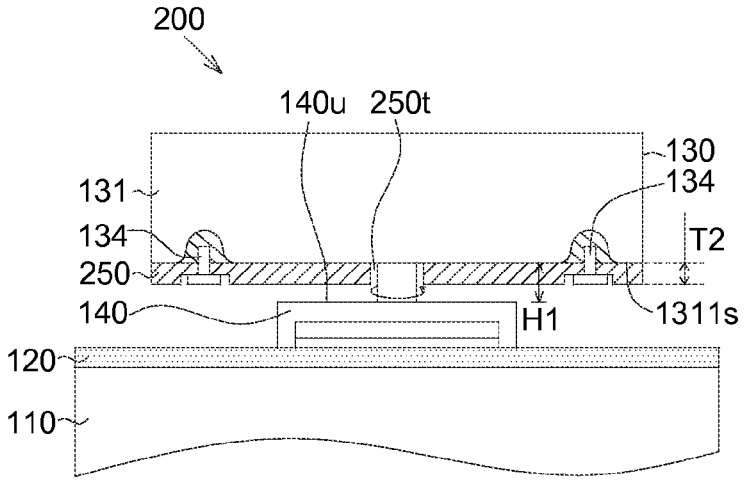
FIG. 4A illustrates a local cross-sectional view of a planarization device according to another embodiment of the invention.

FIG. 4A illustrates a local cross-sectional view of a planarization device according to another embodiment of the invention. The planarization device 200 comprises the platens 110 (only one illustrated in FIG. 4A), the grinding pads 120 (only one illustrated in FIG. 4A), the operation arm 130, the chucks 140 (only one illustrated in FIG. 4A) and the first shielding pads 250 (only one illustrated in FIG. 4A).

In the present embodiment, a thickness T2 of the first shielding pad 250 is less the gap H1 between the first lower surface of the first arm 131 of the operation arm 130 and the upper surface 140*u* of the chuck 140; under the design, the second shielding pad 250 may extend within the gap H1. Since the first shielding pad 250 may extend within the gap H1, the volume of the first notch 250*t* of the first shielding pad 250 is less (in comparison with the first shielding pad 250 does not extend within the gap H1); accordingly, the first shielding pad 250 has adequate strength. In addition, since the first shielding pad 250 may extend within the gap H1, the first shielding pad 250 may cover more area of first lower surface 1131*s* (in comparison with the first shielding pad 250 does not extend within the gap H4), and accordingly the protection area for the first lower surface 1311*s* may be broadened. In another embodiment, the first shielding pad 250 may not extend within interval H1.

Figure 4B:
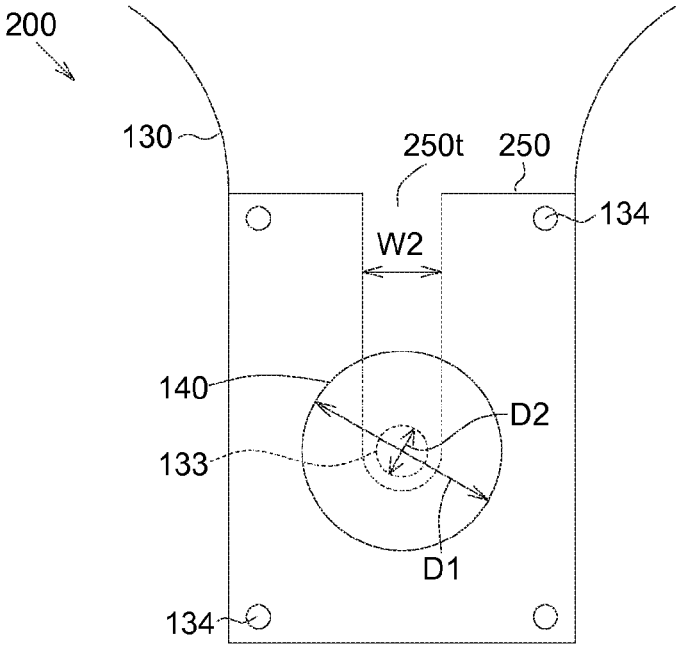
FIG. 4B illustrates a bottom view of the first shielding pad of FIG. 1A.

FIG. 4B illustrates a bottom view of the first shielding pad of FIG. 1A. A width W2 of the first notch 250*t* is less than the outer diameter D1 of the chuck 140 and larger than an outer diameter D2 of the rotating shaft 133, such that the first shielding pad 250 overlaps a portion of the chuck 140, and does not overlap the entire rotating shaft 133. Since the first shielding pad 250 does not overlap the entire rotating shaft 133, the first shielding pad 250 may be prevented from be interfered with the rotating shaft 133.

While the disclosure has been described by way of example and in terms of the exemplary embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A planarization device, comprising:

a platen;

a grinding pad disposed on the platen;

an operation arm having a lower surface;

a chuck rotatably disposed on the operation arm; and a first shielding pad detachably disposed on the lower surface of the operation arm;

wherein a thickness of the first shielding pad is larger than a gap between the operation arm and the chuck, and wherein the first shielding pad extends below an upper surface of the chuck.

2. The planarization device according to claim 1, wherein the first shielding pad is extended within the gap.

3. The planarization device according to claim 1, wherein the first shielding pad has a notch, and an inner diameter of the notch is larger than an outer diameter of the chuck.

4. The planarization device according to claim 1, wherein the first shielding pad has a notch, and an inner diameter of the notch is less than an outer diameter of the chuck.

5. The planarization device according to claim 1 wherein the first shielding pad has a notch, and a bottom surface of the notch is separated from a lateral surface of the chuck by an interval.

6. The planarization device according to claim 1, wherein the first shielding pad has a notch, and the planarization device further comprises:

a second shielding pad disposed between the operation arm and the chuck and located within the notch of the first shielding pad.

7. The planarization device according to claim 1, wherein further comprises:

a locking component fixing a relative position between the first shielding pad and the operation arm.

8. The planarization device according to claim 7, wherein the first shielding pad has a recess and a through hole, the through hole penetrates the first shielding pad from a bottom surface of the recess, the locking component passes through the through hole to fix the first shielding pad to the operation arm, and an end of the locking component is received within the recess.

9. A planarization method for semiconductor structure, comprising:

providing a planarization device according to claim 1;

providing a semiconductor structure, wherein the semiconductor structure comprises a substrate and a layer structure formed on the substrate;

the chuck picking up the semiconductor structure; and the chuck driving the layer structure of the semiconductor structure to rotate and touch the grinding pad for planarizing the layer structure.

10. The planarization method according to claim 9, wherein the first shielding pad is extended within the gap.

11. The planarization method according to claim 9, wherein the first shielding pad has a notch, and an inner diameter of the notch is larger than an outer diameter of the chuck.

12. The planarization method according to claim 9, wherein the first shielding pad has a notch, and an inner diameter of the notch is less than an outer diameter of the chuck.

13. The planarization method according to claim 9 wherein the first shielding pad has a notch, and a bottom surface of the notch is separated from a lateral surface of the chuck by an interval.

14. The planarization method according to claim 9, wherein the first shielding pad has a notch, and the planarization device further comprises:

a second shielding pad disposed between the operation arm and the chuck and located within the notch of the first shielding pad.

15. The planarization method according to claim 9, wherein the planarization device further comprises:

a locking component fixing a relative position between the first shielding pad and the operation arm.

16. The planarization method according to claim 15, wherein the first shielding pad has a recess and a through hole, the through hole penetrates the first shielding pad from a bottom surface of the recess, the locking component pass through the through hole to fix the first shielding pad to the operation arm, and an end of the locking component is received within the recess.

* * * * *